US009366415B2

(12) United States Patent
Jurik et al.

(10) Patent No.: US 9,366,415 B2
(45) Date of Patent: Jun. 14, 2016

(54) FRAMING SHUTTER SYSTEM FOR A LUMINAIRE

(71) Applicants: Pavel Jurik, Prostredni Becva (CZ); Josef Valchar, Prostredni Becva (CZ)

(72) Inventors: Pavel Jurik, Prostredni Becva (CZ); Josef Valchar, Prostredni Becva (CZ)

( * ) Notice: Subject to any disclaimer, the term of this patent is extended or adjusted under 35 U.S.C. 154(b) by 0 days.

(21) Appl. No.: 14/056,927

(22) Filed: Oct. 17, 2013

(65) Prior Publication Data

US 2015/0109797 A1 Apr. 23, 2015

(51) Int. Cl.

| | |
|---|---|
| ***F21V 11/18*** | (2006.01) |
| ***F21V 14/08*** | (2006.01) |
| *F21W 131/406* | (2006.01) |

(52) U.S. Cl.

CPC ..... *F21V 11/18* (2013.01); *F21V 11/186* (2013.01); *F21V 14/08* (2013.01); *F21W 2131/406* (2013.01)

(58) Field of Classification Search

CPC ..... F21V 11/186; F21V 11/18; F21V 11/10; F21V 14/08; F21W 2131/406

USPC ..... 362/321

See application file for complete search history.

(56) References Cited

U.S. PATENT DOCUMENTS

| | | | | |
|---|---|---|---|---|
| 6,744,693 | B2 * | 6/2004 | Brockmann et al. | 362/321 |
| 6,939,026 | B2 * | 9/2005 | Gennrich et al. | 362/322 |
| 8,911,120 | B2 * | 12/2014 | Dalsgaard et al. | 362/321 |
| 8,950,904 | B2 * | 2/2015 | Cavenati et al. | 362/319 |
| 2003/0048640 | A1 * | 3/2003 | Reinert | 362/321 |

* cited by examiner

*Primary Examiner* — Peggy Neils

(57) ABSTRACT

Described are an improved automated luminaire 12 and luminaire systems 10 employing an improved automated framing shutter mechanism 18 for an automated luminaire which provides rapid and accurate operation via a five-bar linkage driven by two motors for each shutter blade constrained by spacer plates and with a circular aperture integrated between at least two of the shutter blades.

14 Claims, 15 Drawing Sheets

FRAMING SHUTTER SYSTEM FOR A LUMINAIRE

TECHNICAL FIELD OF THE INVENTION

The present invention generally relates to an automated framing shutter system, specifically to a framing shutter system for use within an automated luminaire.

BACKGROUND OF THE INVENTION

Luminaires with automated and remotely controllable functionality are well known in the entertainment and architectural lighting markets. Such products are commonly used in theatres, television studios, concerts, theme parks, night clubs and other venues. A typical product will commonly provide control over the pan and tilt functions of the luminaire allowing the operator to control the direction the luminaire is pointing and thus the position of the light beam on the stage or in the studio. Typically this position control is done via control of the luminaire's position in two orthogonal rotational axes usually referred to as pan and tilt. Many products provide control over other parameters such as the intensity, color, focus, beam size, beam shape and beam pattern. The beam pattern is often provided by a stencil or slide called a gobo which may be a steel, aluminum or etched glass pattern. The products manufactured by Robe Lighting such as the Robin 300E Spot are typical of the art.

The optical systems of such luminaires may include a gate or aperture through which the light is constrained to pass. Mounted in or near this gate may be devices such as gobos, patterns, irises, color filters or other beam modifying devices as known in the art. The use of a framing shutter system at this point allows control over the size and shape of the output beam and thus the size and shape of the image projected onto a surface.

FIG. 1 illustrates a multiparameter automated luminaire system 10. These systems commonly include a plurality of multiparameter automated luminaires 12 which typically each contain on-board a light source (not shown), light modulation devices, electric motors coupled to mechanical drives systems and control electronics (not shown). In addition to being connected to mains power either directly or through a power distribution system (not shown), each luminaire is connected is series or in parallel to data link 14 to one or more control desks 15. The luminaire system 10 is typically controlled by an operator through the control desk 15.

FIG. 2 illustrates an automated luminaire 12 incorporating the improved shutter system 25. A lamp 21 contains a light source 22 which emits light which may have a power supply 27. The light is reflected and controlled by reflector 20 through color system 23 which may include dichroic color mixing and color wheels, an aperture or imaging gate 24 and then through a framing shutter system 25. The resultant light beam may be further constrained, shaped, colored and filtered by optical devices 26 which may include dichroic color filters, gobos, rotating gobos, variable aperture iris, effects glass and other optical devices well known in the art. The final output beam may be transmitted through output lenses 28 and 31 which may form a zoom lens system.

Framing shutter system 25 is most commonly constructed as a plurality of metal plates or blades that may be individually and separately inserted across the light beam to mask a portion of that beam. Each blade may be completely removed from the light beam or may be adjusted to occlude a portion of the light beam. It is possible to use any number of blades; however it is common to utilize four allowing framing the projected image to common rectangular shapes such as picture frames. It is also well known to provide individual angular control for each blade such that the four blades do not have to remain at fixed, perpendicular, angle to each other and thus irregular trapezoidal or triangular shapes may be formed by combinations of the blades.

The prior art contains various examples of such framing shutter systems, for example U.S. Pat. No. 1,793,945 illustrates a four blade system where each blade may be manually adjusted to cover a portion of the light beam. This system does not provide beam rotation. U.S. Pat. No. 4,890,208 to Izenour discloses a further four blade system where each blade is provided with two motors such that both the position and angle of each blade can be remotely adjusted. US Patent Application 2005/02319578 to Wynne-Willson discloses a yet further system where each blade can be remotely adjusted for position and rotation and may also be rotated around the beam. Wynne-Willson further discloses that each blade may have two selectable edges which may be optionally inserted across the beam. He illustrates this as a straight edge or a curved edge. This offers some advantage to the user as shapes other than straight sided polygons can be framed, however the system disclosed is a very complex mechanism which would be expensive and difficult to manufacture. Further mechanisms are disclosed in U.S. Pat. No. 6,550,939, U.S. Pat. No. 6,744,693, U.S. Pat. No. 6,939,026, European patent EP 1428070, patent application WO 96/26384 and UK Patent GB2270969. All of these mechanisms offer some means for framing at least two sides of a light beam and may also provide position and rotation of each blade however the described mechanisms are either slow to operate, such as EP1428070 or one embodiment of WO 96/26384 which rely upon a lead screw system, or have many interconnected parts which lead to inaccuracies from tolerances in the system.

There is a need for an improved automated framing shutter mechanism for an automated luminaire which provides the user with both accurate positioning and the ability for rapid movement.

BRIEF DESCRIPTION OF THE DRAWINGS

For a more complete understanding of the present invention and the advantages thereof, reference is now made to the following description taken in conjunction with the accompanying drawings in which like reference numerals indicate like features and wherein.

DETAILED DESCRIPTION OF THE INVENTION

Preferred embodiments of the present invention are illustrated in the FIGUREs, like numerals being used to refer to like and corresponding parts of the various drawings.

The present invention generally relates to an automated luminaire, specifically to the configuration of an improved automated framing shutter mechanism within such a luminaire which provides the user with more than two selectable edge shapes for each shutter blade.

Figure 1:
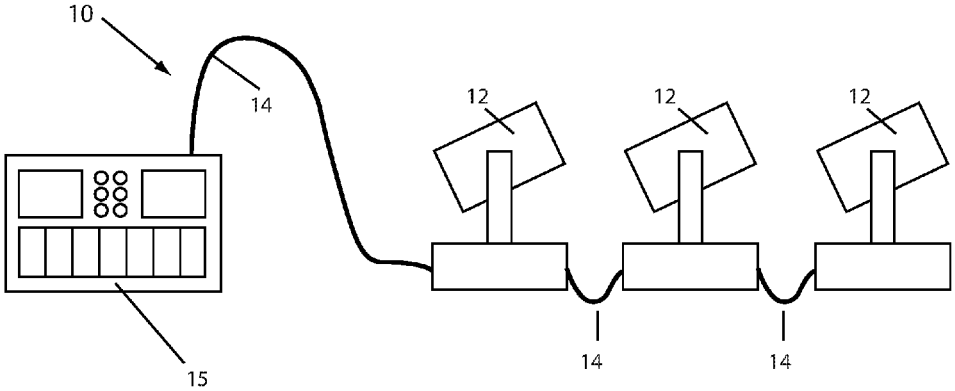
FIG 1 (Prior Art)
FIG. 1 illustrates a typical automated lighting which may include luminaire(s) with framing shutter system(s)
Figure 2:
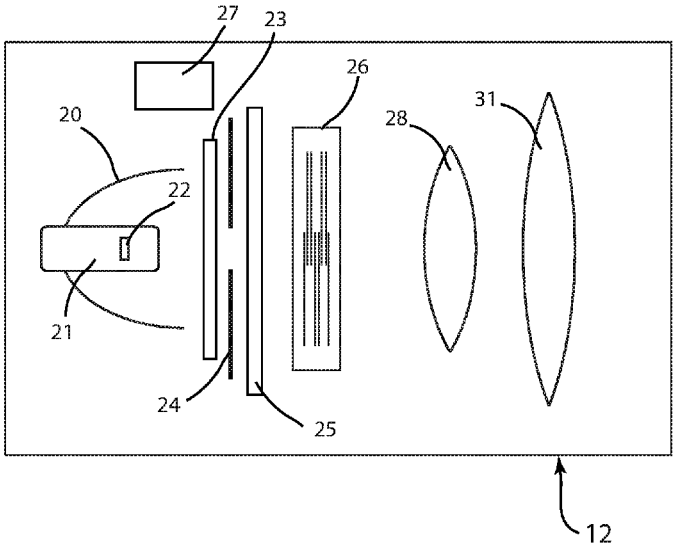
FIG 2 (Prior Art)
FIG. 2 illustrates an automated luminaire with a framing shutter system.
Figure 3:
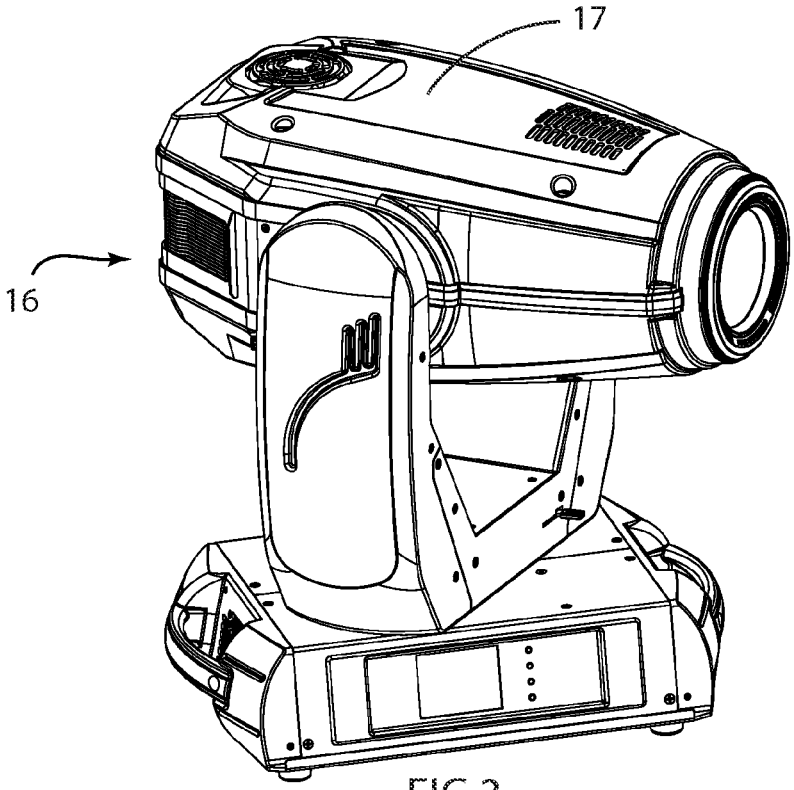
FIG. 3 illustrates an automated luminaire containing an embodiment of the framing shutter system.
Figure 4:
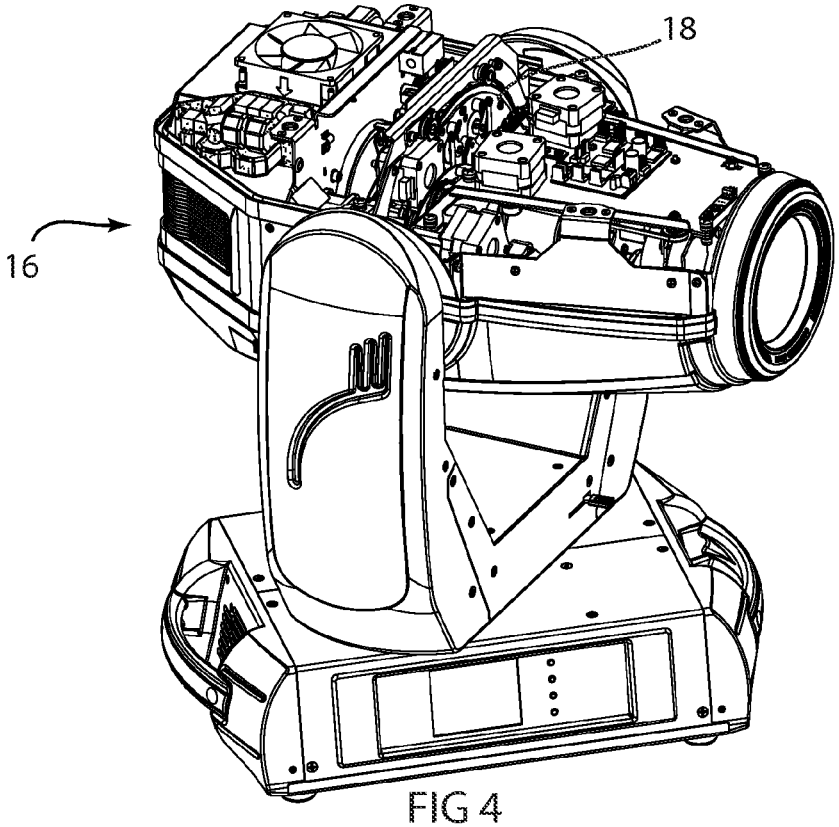
FIG. 4 illustrates the automated luminaire of FIG. 3 with a cover removed revealing a portion and the location its framing shutter system.
Figure 5:
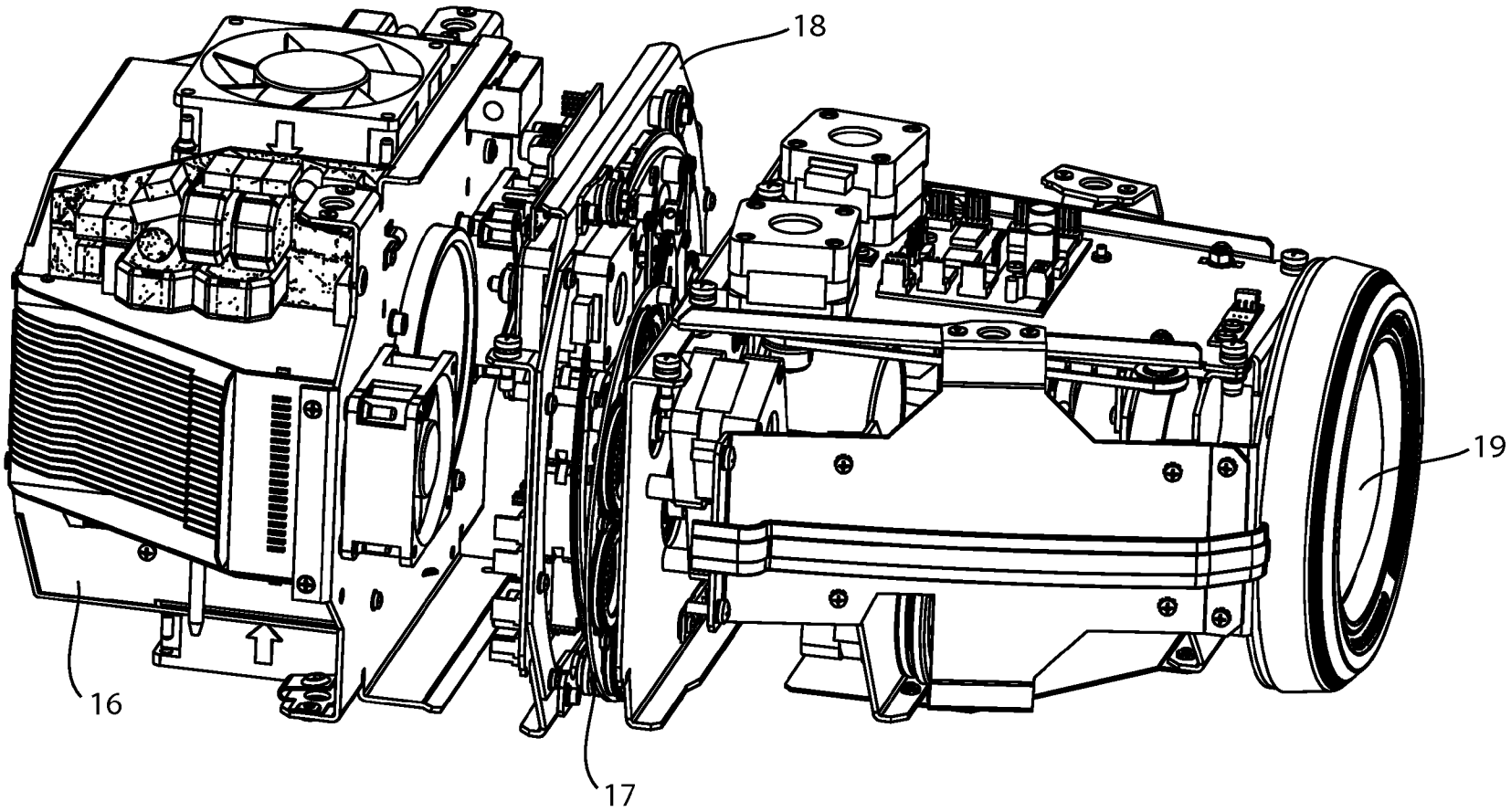
FIG. 5 illustrates an exploded view of select parts of the automated luminaire of FIG. 4 including its framing shutter system.

FIG. 3 illustrates an automated luminaire 16 containing an embodiment of the framing shutter system of the invention. The luminaire 16 is illustrated with its top cover 17 which is removed in Figure revealing the luminaire's internal mechanisms, including the framing shutter mechanism 18. FIG. 5 illustrates the automated luminaire 16 with all covers removed to more fully reveal the internal mechanisms, including the framing shutter mechanism 18. The framing shutter system 18 may be positioned at a point in the optical train such that the output optics 19 is capable of providing a hard edge focus of the shutter blades and/or the aperture separations plates (as discussed below) in the output beam. The framing shutter mechanism may be adjacent to other optical devices such as gobo wheel 17.

Figure 6:
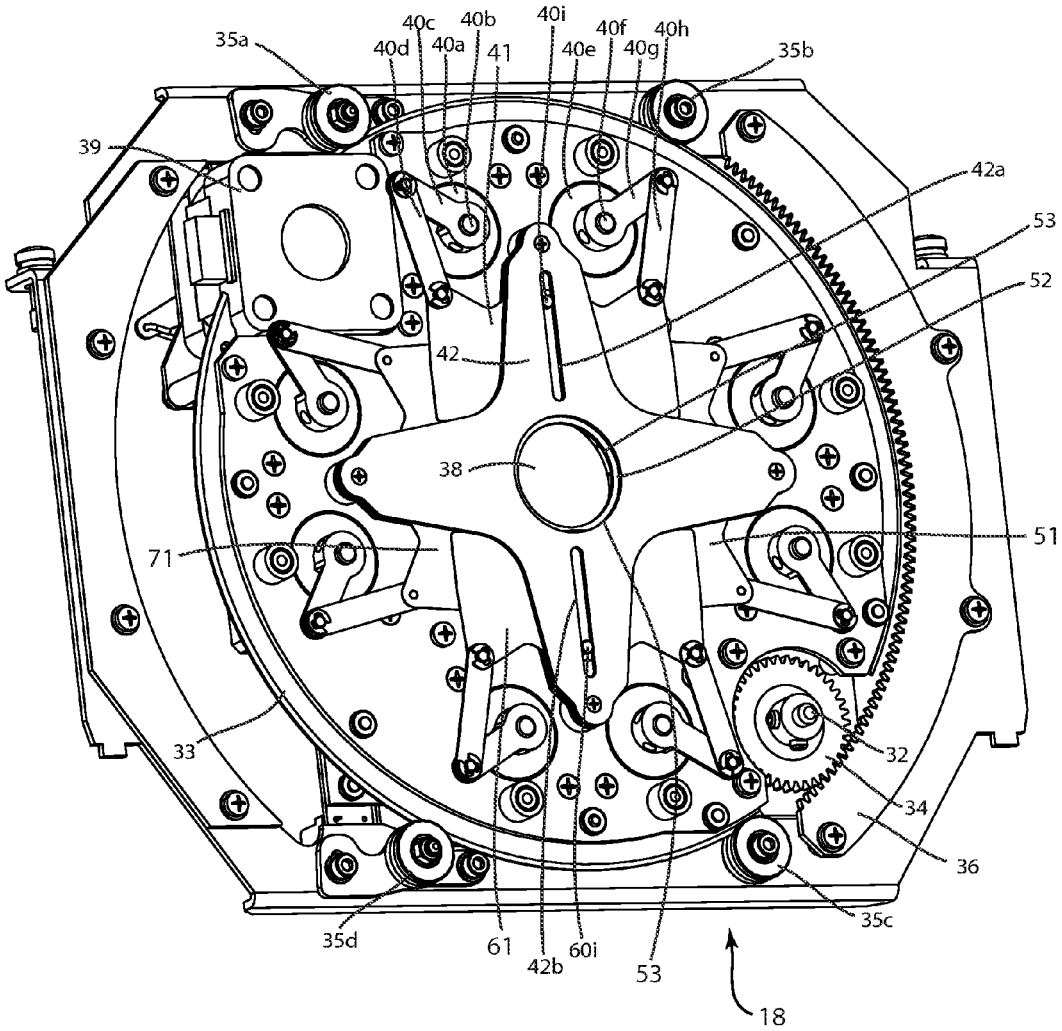
FIG. 6 illustrates a front perspective view of the framing shutter system from FIG. 5.

FIG. 6 illustrates an embodiment of the invention. Framing shutter mechanism 18 has been removed from the automated luminaire so as to simplify the description of the invention. Central aperture 38 provides the main light path for the optical system of the luminaire for a constrained light beam. The aperture 38 and framing shutter system 18 are positioned at a point in the optical train such that the output optics may provide a hard edge focus of the shutter blades in the output beam. In the embodiment illustrated the aperture 38 is defined by the central aperture 53 in one of the bracketed separator plates 52 (the second separator plate as further discussed below). In the embodiment shown (though not shown in FIG. 6, the central aperture in the third separator plate also defines the central aperture 38. Note that in the embodiment shown the first separator plate 42 has a central opening 43 that does not define the aperture of the light optical system. In other embodiments it may provide this function. Blades 41, 51, 61 and 71 are framing shutter blades. With the mechanism in the state as illustrated in FIG. 6 the shutter blades 41, 51, 61 and 71 are outside of the central aperture 38 causing no occlusion of the light beam allowing the light beam to pass through the framing shutter system 18 unchanged.

Each of the blades 41, 51, 61 and 71 may be separately and independently moved towards or away the central aperture 38. The operation of all four blades is substantially similar and for the sake of clarity, just the operation of shutter blade 41 will be herein described. It is to be understood that shutter blades 51, 61 and 71 operate in a similar manner through their respective motors and drive systems.

Shutter blade 41 is connected by a first two bar linkage 40*c* and 40*d* to the shaft 40*b* of motor 40*a*. Shutter blade 41 is further connected by a second two bar linkage 40*g* and 40*h* to the shaft 40*f* of motor 40*e*. Shutter blade 41 is constrained by pin 40*i* which runs in a slot 42*a* in first and second separator plates 42 and 52 (slot in the second separator plate is not shown in FIG. 6). Pin 40*i* constrains the central point of shutter blade 41 to move in a direction radial to aperture 38, shutter blade 41 may further rotate about pin 40*i* to provide rotation of the shutter blade and thus the projected blade image. The entire mechanism 40*c*, 40*d*, 41, 40*h* and 40*g* provides a five bar linkage. Coordinated rotation of motors 40*c* and 40*e* allows both linear movement of shutter blade 41 along a direction radial to aperture 38, and altering the tilt angle of shutter blade 41 relative to the slot 42*a* in first separator plate 42. Shutter blades 51, 61 and 71 may be similarly moved and tilted by their respective motors and linkage systems.

Figure 7:
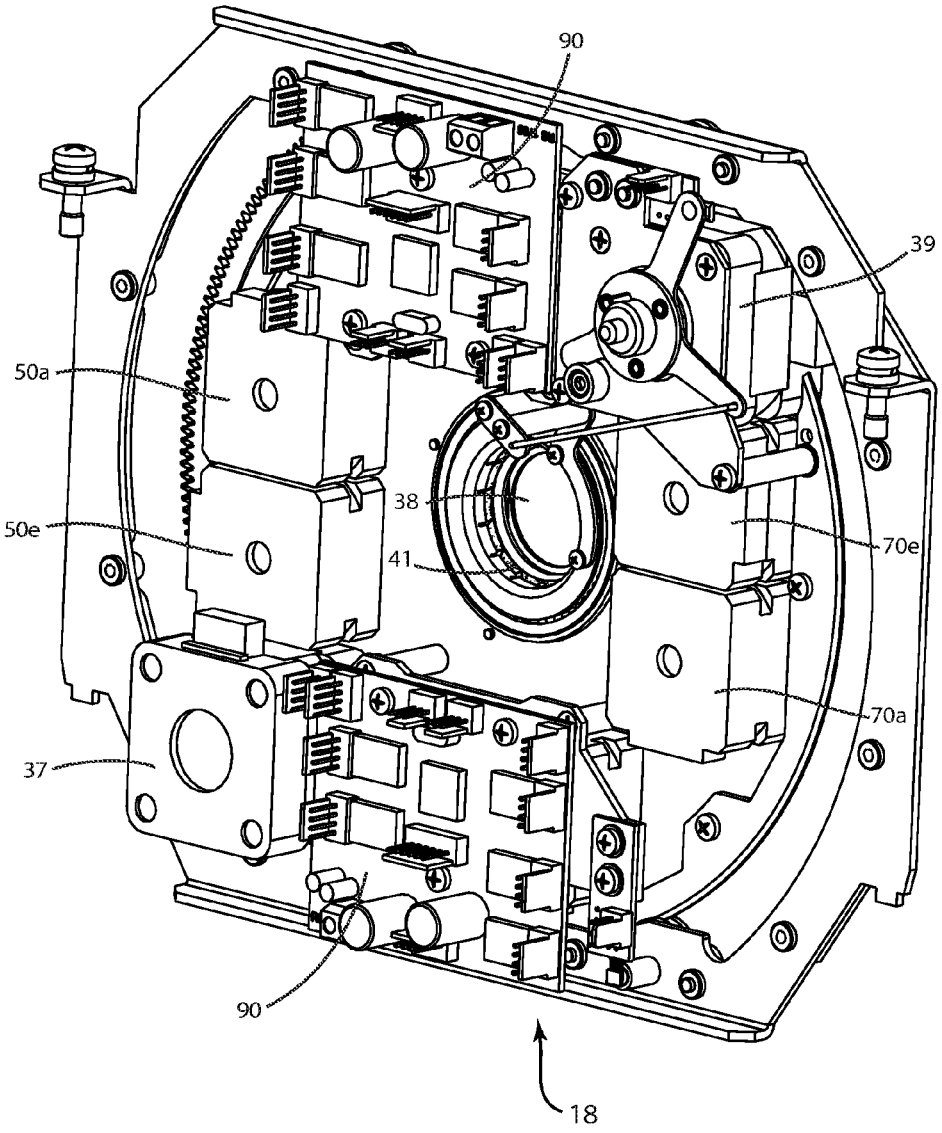
FIG. 7 illustrates the rear side of an embodiment of the framing shutter system of FIG. 6.

FIG. 7 illustrates a rear view of the embodiment of the framing shutter system 18 illustrated in FIG. 6. Motors 50*a* and 50*e* which drive shutter blade 51, and motors 70*a* and 70*e* which drive shutter blade 71 may be seen. An automated iris 41 mechanism may further be mounted on the framing shutter mechanism 18. Iris 41 is mounted adjacent to the framing shutters (not easily identified in FIG. 7), surrounding aperture 38. Operation of motor 39 will open and close iris 41 across aperture 38. It is advantageous to position iris 41 adjacent to the framing shutters so that the optical system may easily focus on one or both mechanisms. Motor 37 may also be fitted to provide rotation for the entire framing shutter system as later described. FIG. 7 also illustrates electronic circuitry/motor drivers associated with driving and controlling the movement of motors (including 50*a*, 50*e*, 70*a*, 70*e*, and 39).

Figure 8:
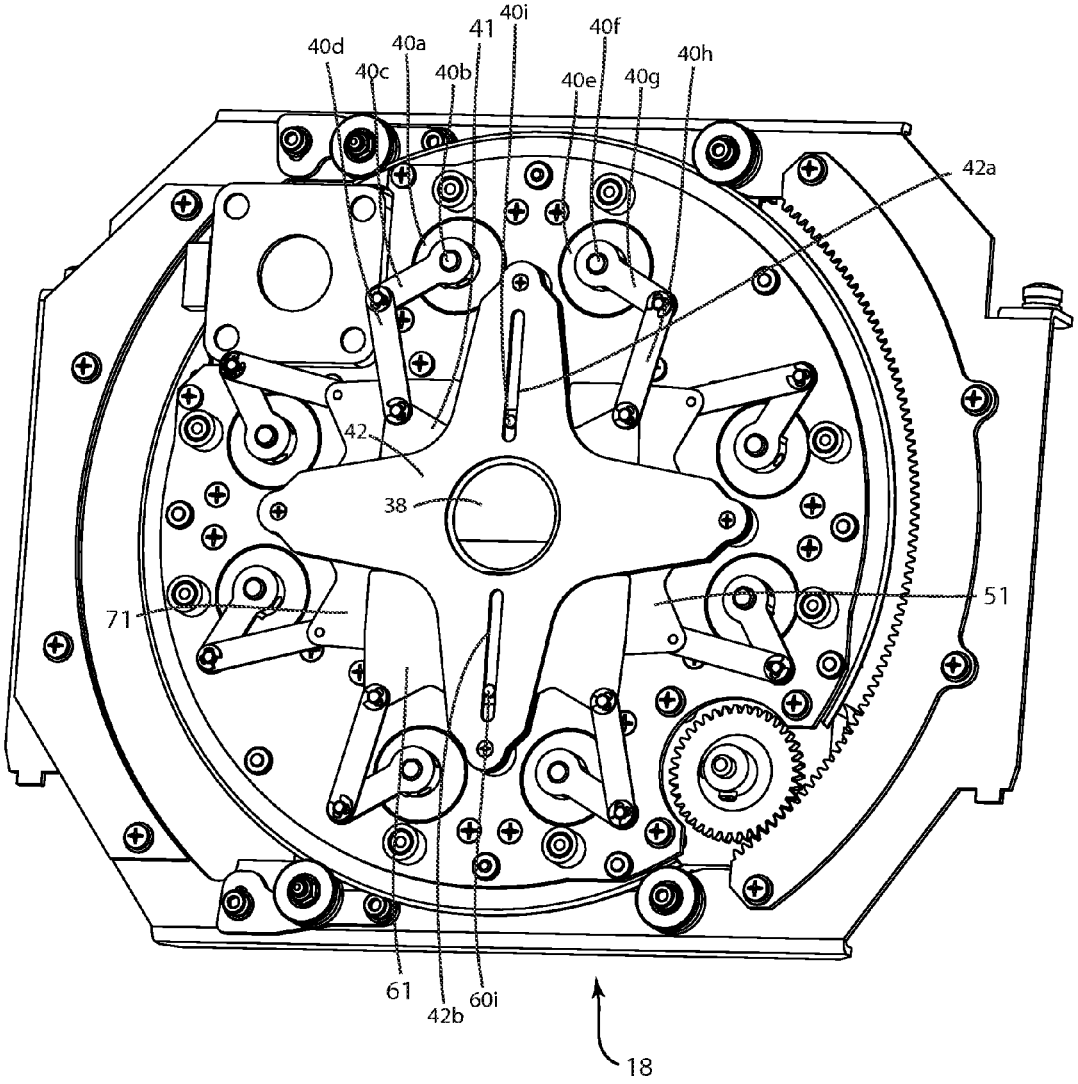
FIG. 8 illustrates the operation of one of the shutter blades of the framing shutter system of FIG. 6.

FIG. 8 illustrates the framing shutter system shown in FIG. 6 with shutter blade 41 inserted partway across aperture 38. Motor 40*a* has rotated its output shaft 40*b* counter clockwise such that linkages 40*c* and 40*d* move the left side of blade 41 down. Similarly, motor 40*e* has rotated its output shaft 40*f* clockwise such that linkages 40*g* and 40*h* move the right side of blade 41 down. Pin 40*i* also moves down in the slot 42*a* in first separator plate 42. Shutter blade 41 now covers a proportion of aperture 38. In this illustration, the counter clockwise rotation of motor 40*a* and the clockwise rotation of motor 40*e* are equal such that shutter blade 41 remains parallel to its original position, with no rotation around pin 40*i*. In this embodiment shutter blade 41 may occlude more than half, approximately 60%, of aperture 38. As the blades may each occlude greater than 50% of the aperture, it can be seen that by bringing in two opposing blades (41 and 61, or 51 and 71) the user may completely occlude the aperture and block all light. With all four blades operating across the aperture the system may behave like a square iris moving from a fully open aperture through to a fully occluded aperture.

Figure 9:
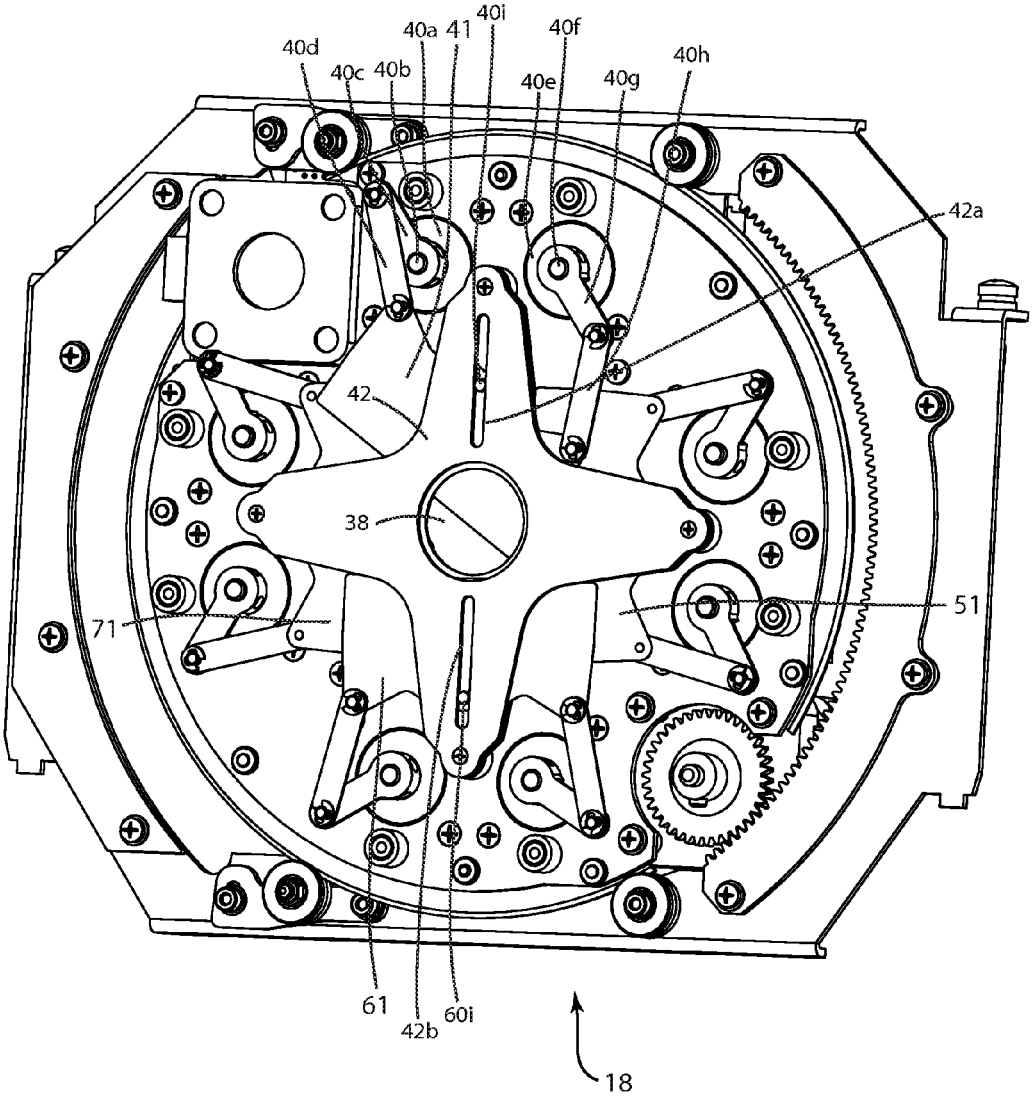
FIG. 9 further illustrates the operation the blade from FIG. 8.

FIG. 9 illustrates the framing shutter system shown in FIG. 6 with shutter blade 41 inserted partway across aperture 38. Motor 40*a* has rotated its output shaft 40*b* clockwise such that linkages 40*c* and 40*d* move the left side of blade 41 up. Similarly, motor 40*e* has rotated its output shaft 40*f* clockwise such that linkages 40*g* and 40*h* move the right side of blade 41 down. Shutter blade 41 now covers a proportion of aperture 38. In this illustration, the relative rotations of motor 40*a* and motor 40*e* cause shutter blade 41 to rotate clockwise around pin 40*i* such that shutter blade 41 is positioned at an angle across aperture 38.

Figure 10:
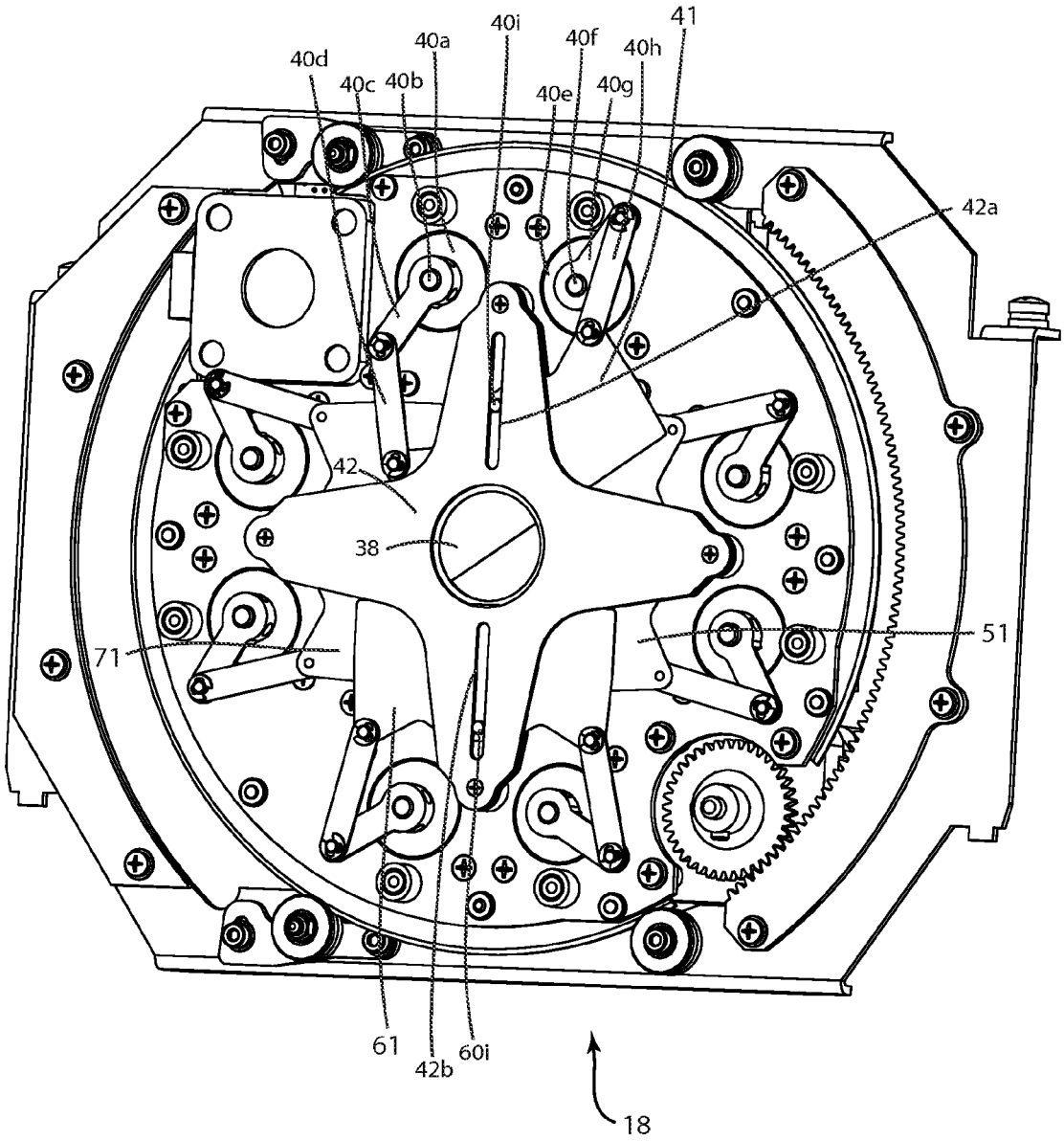
FIG. 10 further illustrates the operation of the blade from FIG. 8 and FIG. 9.

FIG. 10 illustrates the framing shutter system shown in FIG. 6 with shutter blade 41 inserted across aperture 38. Motor 40*a* has rotated its output shaft 40*b* counter clockwise such that linkages 40*c* and 40*d* move the left side of blade 41 down. Similarly, motor 40*e* has rotated its output shaft 40*f* counter clockwise such that linkages 40*g* and 40*h* move the right side of blade 41 up. Shutter blade 41 now covers a proportion of aperture 38. In this illustration, the relative rotations of motor 40*a* and motor 40*e* cause shutter blade 41 to rotate counter clockwise around pin 40*i* such that shutter blade 41 is positioned at an angle across aperture 38. The shutter blade position shown in FIG. 10 is tilted in the opposite direction to the position shown in FIG. 9. It can be seen that, by appropriate and independent rotation of motors 40*a* and 40*e*, shutter blade 41 may be adjustably moved across aperture 38 and the angle that it crosses aperture 38 may be simultaneously and separately controlled. Thus the user may position shutter blade 41 at any desired position and at any desired angle across aperture 38.

The pivot point connections s 40*j*, 40*k*, 40*m* and 40*n* between linkages 40*c* and 40*d*, between linkages 40*g* and 40*h*, and from said linkages to shutter plate 41 may be of tight tolerance such that mechanical hysteresis or backlash is minimized. Such a system may be accurately positioned. Further, because of the small angle of rotation required for motors 40*a* and 40*e* to move from one extreme position to the other, and the mechanical advantage of the two bar linkage system, said movement may be very rapid. In one embodiment the mechanism is capable of moving the shutter blade from a first position out of the beam to a second position across the beam within 0.15 second. This compares with prior art systems which typically take 0.3 seconds or longer to achieve the same result. This high speed and accurate operation allows use of the framing system as a theatrical effect as well as providing accurate optical beam framing.

Figure 11:
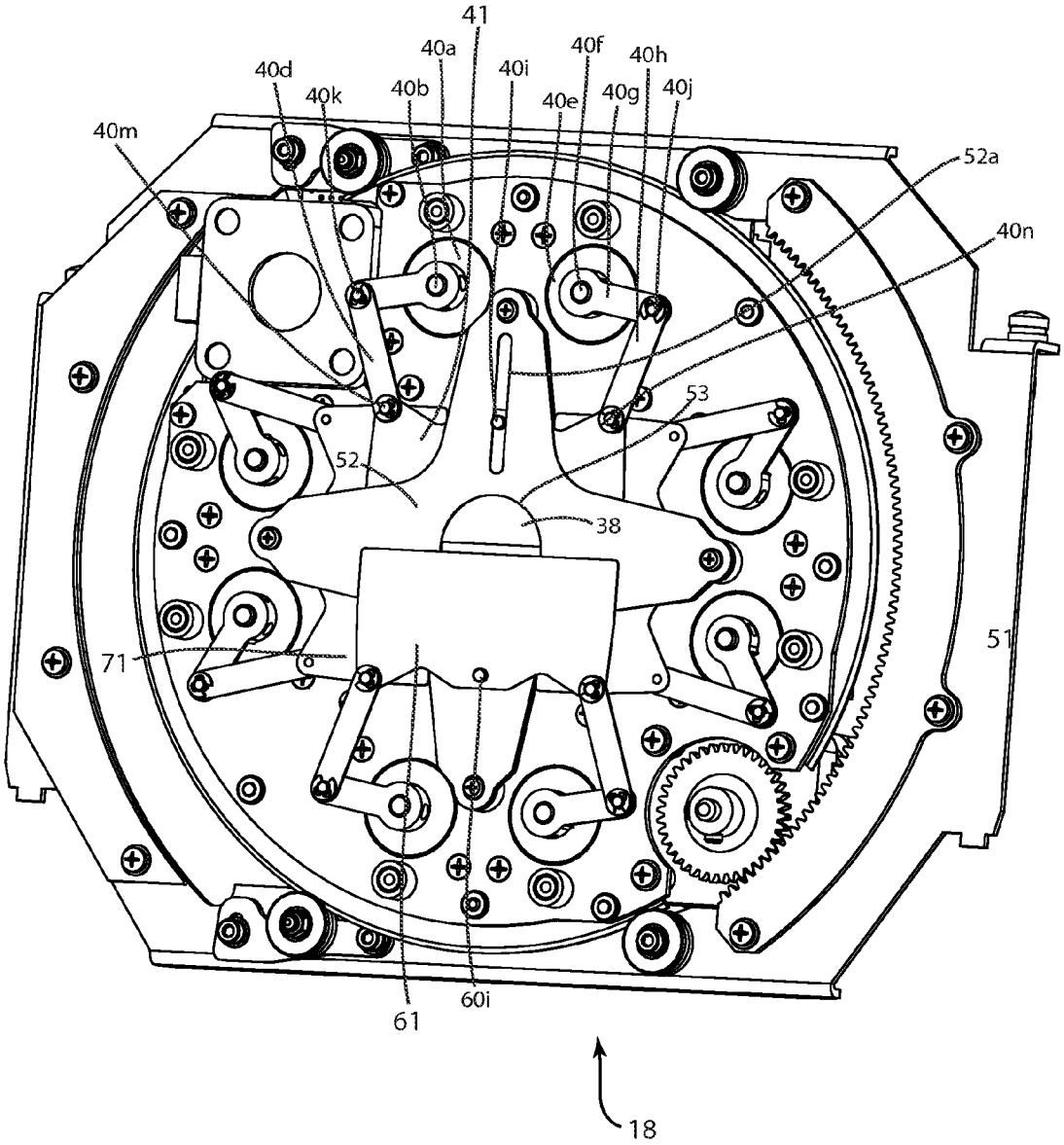
FIG. 11 illustrates the embodiment of the framing shutter system of FIG. 6 with the first separator plate removed.

FIGS. 11, 12 13, 14 and 15 illustrate the disassembly of an embodiment of the invention in order to more easily describe the stacking of shutter blades and separator plates in the central mechanism. FIG. 11 illustrates the framing system shown in FIG. 6, but with the first separator plate 42 removed. With first separator plate 42 removed we can now fully see first shutter blade 61 and second separator plate 52. First shutter blade 61 runs in the gap between first separator plate 42 and second separator plate 52.

Figure 12:
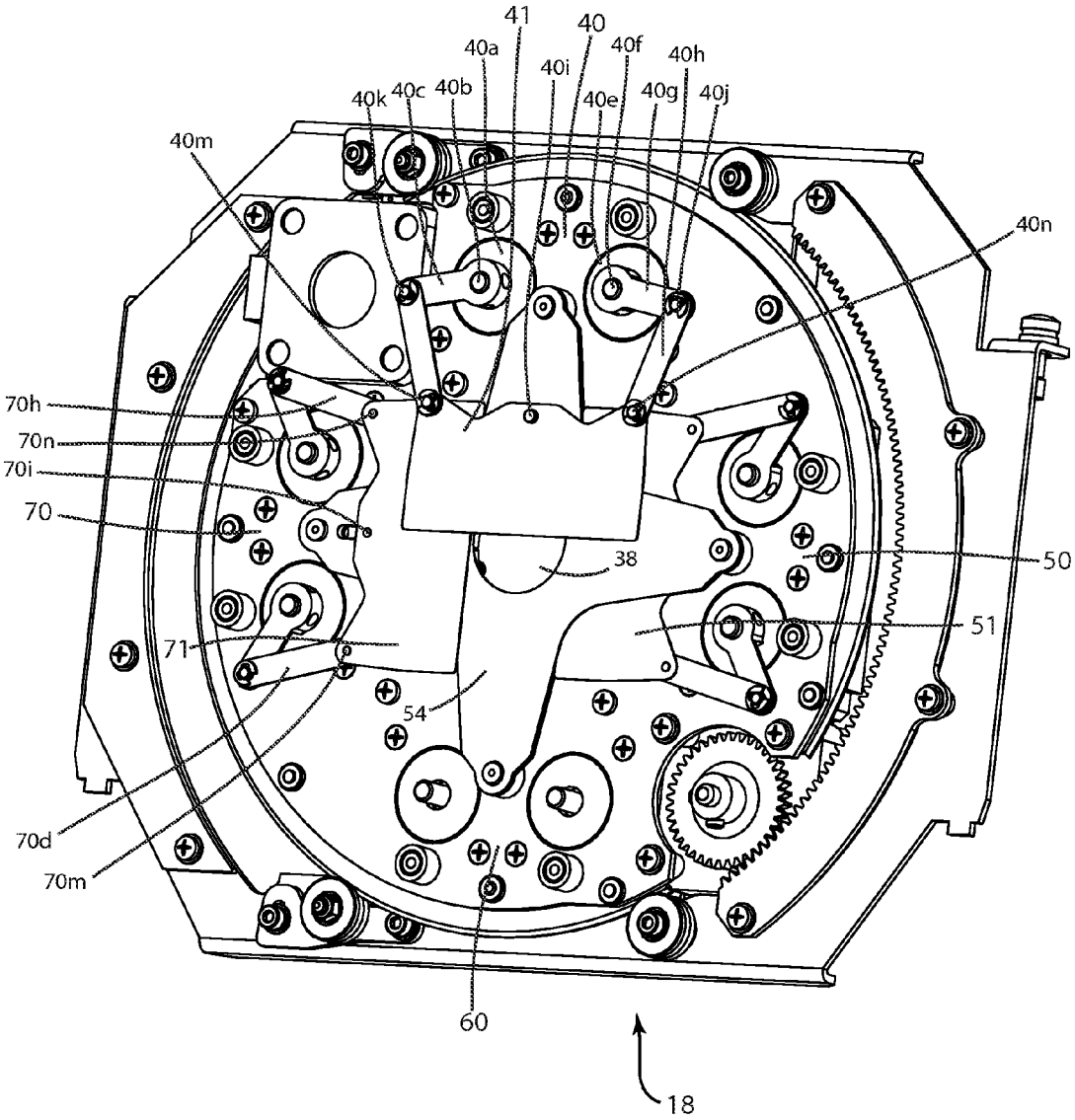
FIG. 12 illustrates an embodiment of the framing shutter system of FIG. 6 with a first shutter blade and second separator plate removed.

FIG. 12 illustrates the framing system shown in FIG. 11, but with the first shutter blade 61 and second separator plate 52 removed. We can now see second shutter blade 41, third shutter blade 71 and third separator plate 54. Second shutter blade 41 and third shutter blade 71 both run in the gap between second separator plate 52 and third separator plate 54. Because the movements of second shutter blade 41 and third shutter blade 71 are essentially orthogonal to each other, they may run in the same slot and in contact with each other without interfering with each other's movement. This has the further advantage that second shutter blade 41 and third shutter blade 71 are as close to each other as possible along the optical axis of the luminaire and thus will effectively be in sharp focus in the optical system at the same time. Note that that pivot point connections 40*m* and 40*n* for shutter blade 41 are configured so that they protrude on top of the blade 41 and flush on the other side (not shown) while the pivot point connections 70*m* and 70*n* for shutter blade 71 are configured so they protrude below the blade (not shown) rather than on top. In this way the pivot point connections do not interfere with the movement of shutter blades 41 and 71 relative to each other. The configuration of these blades is such that they always overlap. There is no combination of positions of these blades that they do not overlap and thus loose their orientation in the stack.

Figure 13:
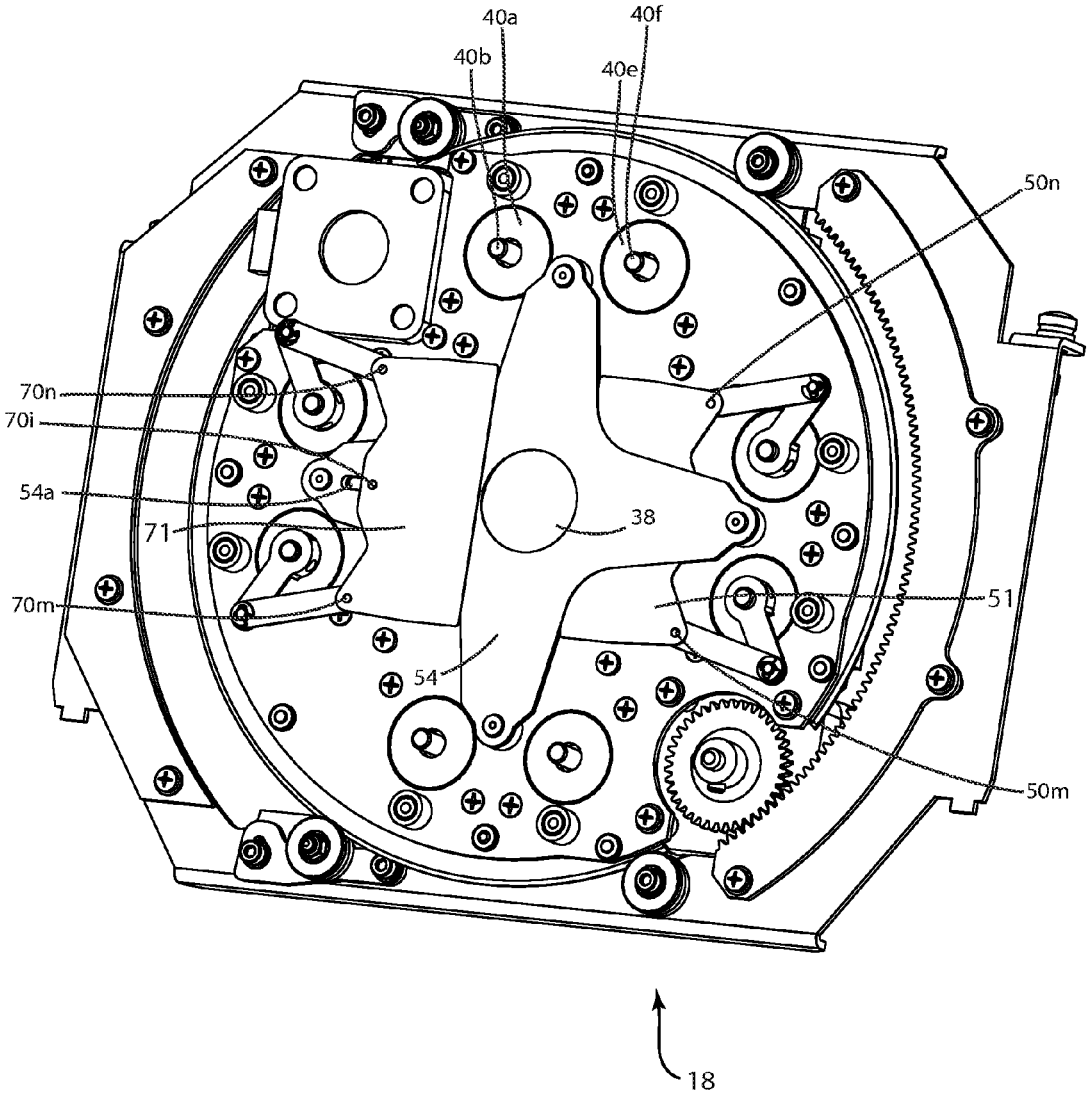
FIG. 13 illustrates an embodiment of the invention with a second shutter blade removed.

FIG. 13 illustrates the framing system shown in FIG. 12, but with second shutter blade 41 removed.

Figure 14:
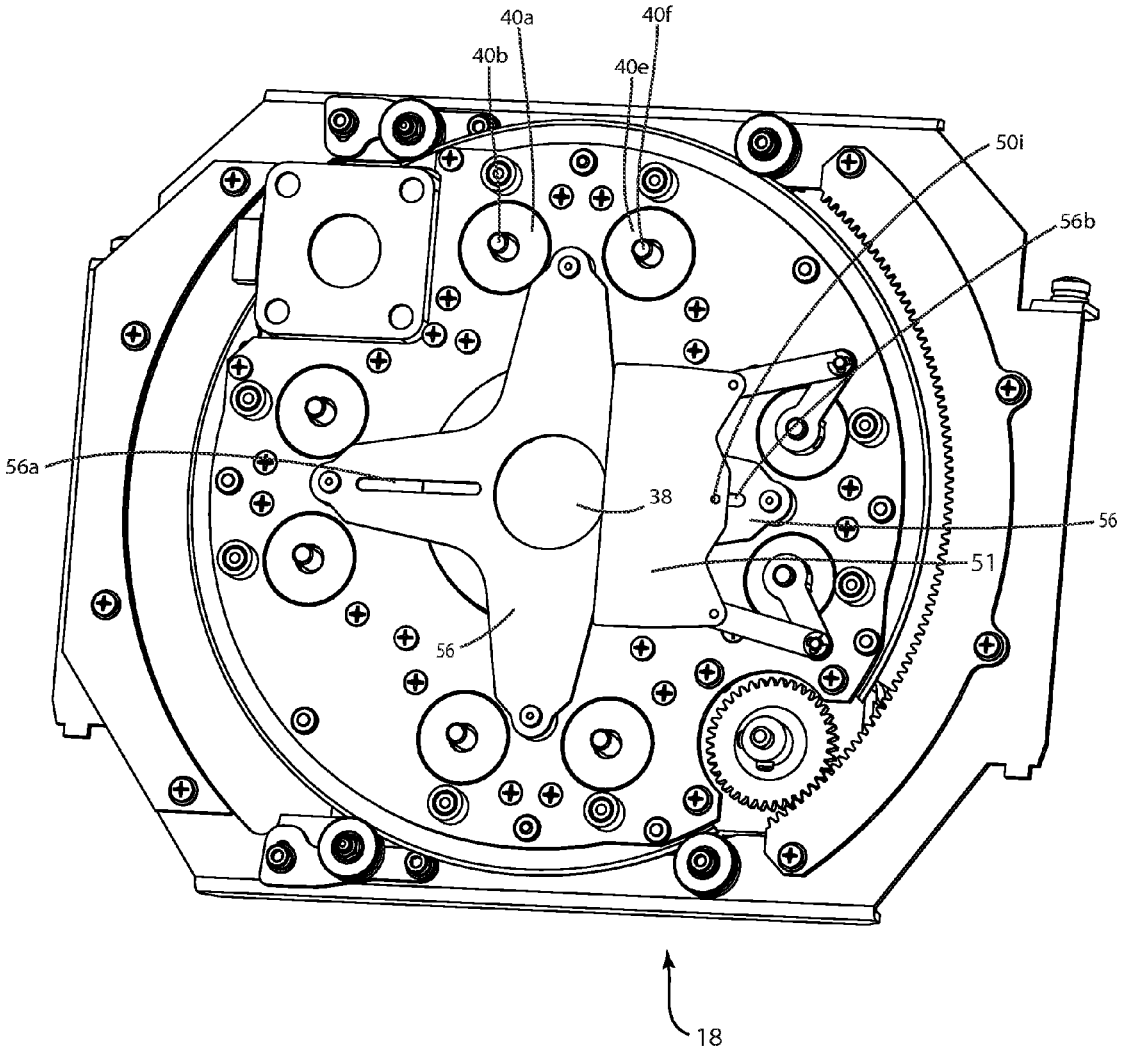
FIG. 14 illustrates an embodiment of the framing shutter system of FIG. 6 with a third shutter blade and third separator plate removed.

FIG. 14 illustrates the framing system shown in FIG. 13, but with third shutter blade 71 and third separator plate 54 removed. We can now see fourth shutter blade 51 and fourth separator plate 56. Fourth shutter blade 51 runs in the gap between third separator plate 54 and fourth separator plate 56.

In the embodiment shown in FIGS. 11, 12, 13 and 14, the stack of shutter blades and separator plates run as follows:

1st separator plate 42
1st shutter blade 61
2nd separator/aperture plate 52
2nd shutter blade 41
3rd shutter blade 71
3rd separator/aperture plate 54
4th shutter blade 51
4th separator plate 56

It can be seen from the these Figures that each of the four shutter blades has an associated separator plate such that the pin on each blade runs in the slot of its associated separator plate. As previously described these pins provide both location for the shutter blades and a pivot point for the shutter blade to rotate around. In one embodiment the pin 40*i* on second shutter blade 41 may extend through the slots 52*a* and 42*a* in both second separator plate 52 and first separator plate 42. Similarly the pin 70*i* on the third shutter blade 71 may extend through the slots 54*a* and 56*a* in both the third separator plate 54 and fourth separator plate 56. This construction removes limitations on the length of the pins and thus simplifies and facilitates the manufacture and assembly of the mechanism. In the embodiment shown, the pins on first and second shutter blades face in a first direction while those on the third and fourth shutter blades face in a second direction, opposite to the first direction. Additionally, in the embodiment shown the first and second shutter blades are generally enter the light beam from opposite sides and the third and fourth shutter blades generally enter the light beam from opposite sides.

In other less preferred embodiments there may be a separation plate between the second and third shutter blades. However, in embodiments without such a separation plate it is important that the as least some portion(s) of blades without separation plates overlap so they do not lose their order in the stack. In other embodiments the order of the stack may be different provided that the pin that constrains the movement of its shutter blade does not interfere with the movement of another shutter blade. Additionally in other embodiments the spacer plates may each have multiple slots to accommodate the movements of extended pins for shutter blades to which they are not immediately adjacent.

Note also that in the embodiment shown both the separation plates 52 and/or 54 also serve as apertures for the optical system.

Figure 15:
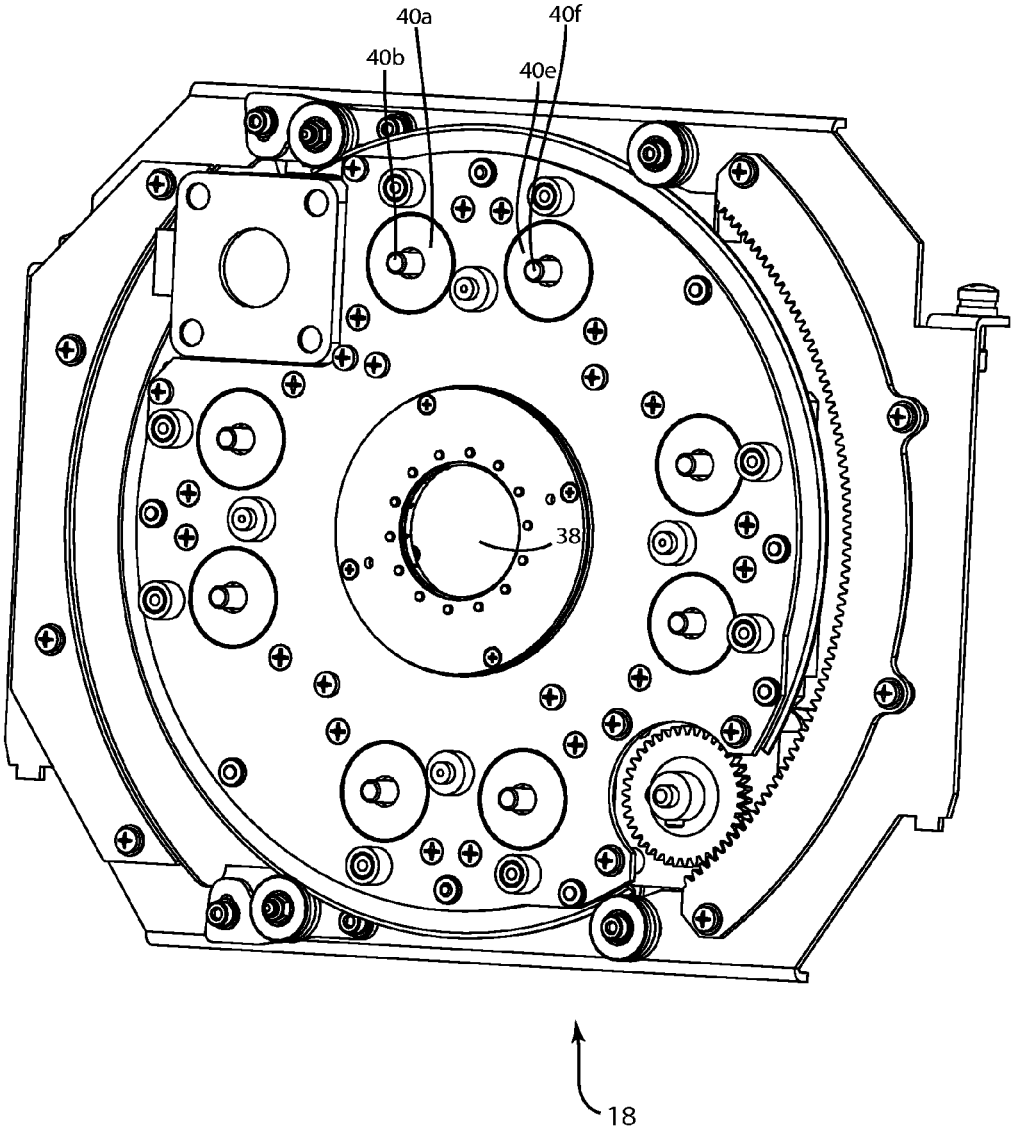
FIG. 15 illustrates an embodiment of the framing shutter system of FIG. 6 with all shutter blades and all separator plates removed.
Figure 16:
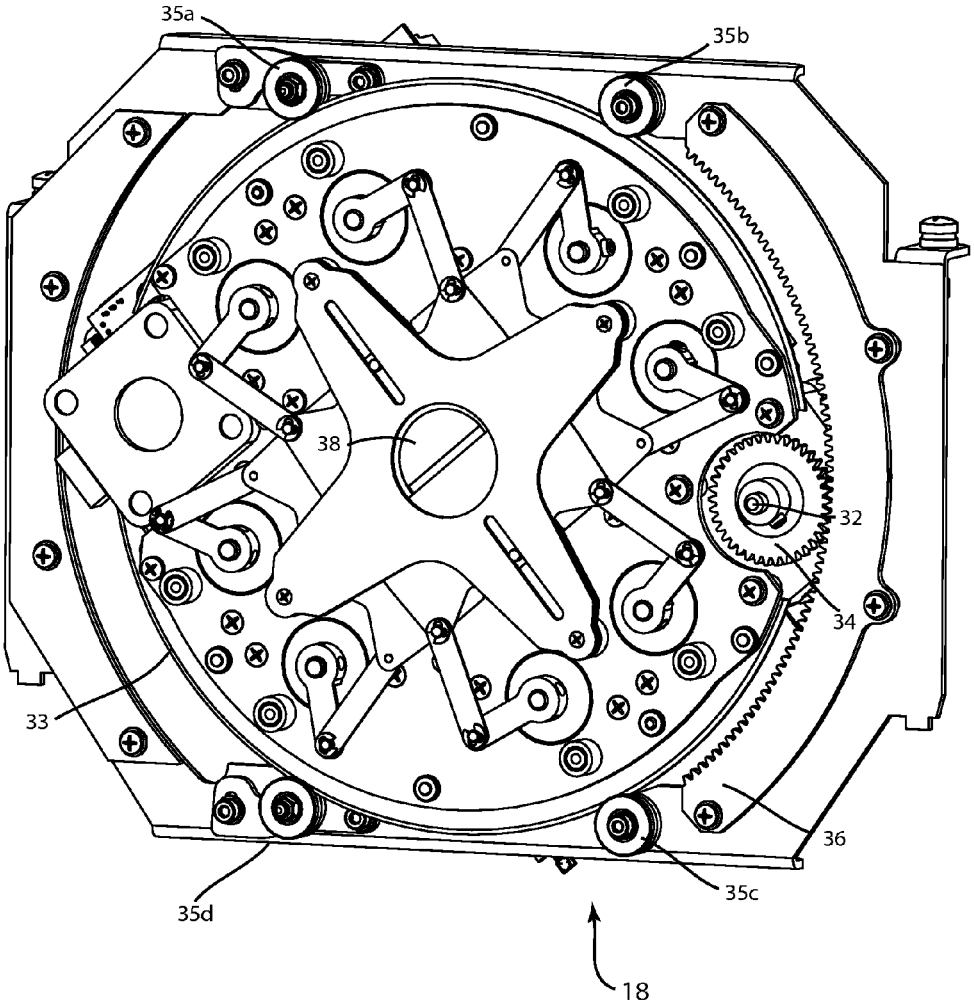
FIG. 16 illustrates an embodiment of the framing shutter system of FIG. 6 with the shutter mechanism rotated.
Figure 17:
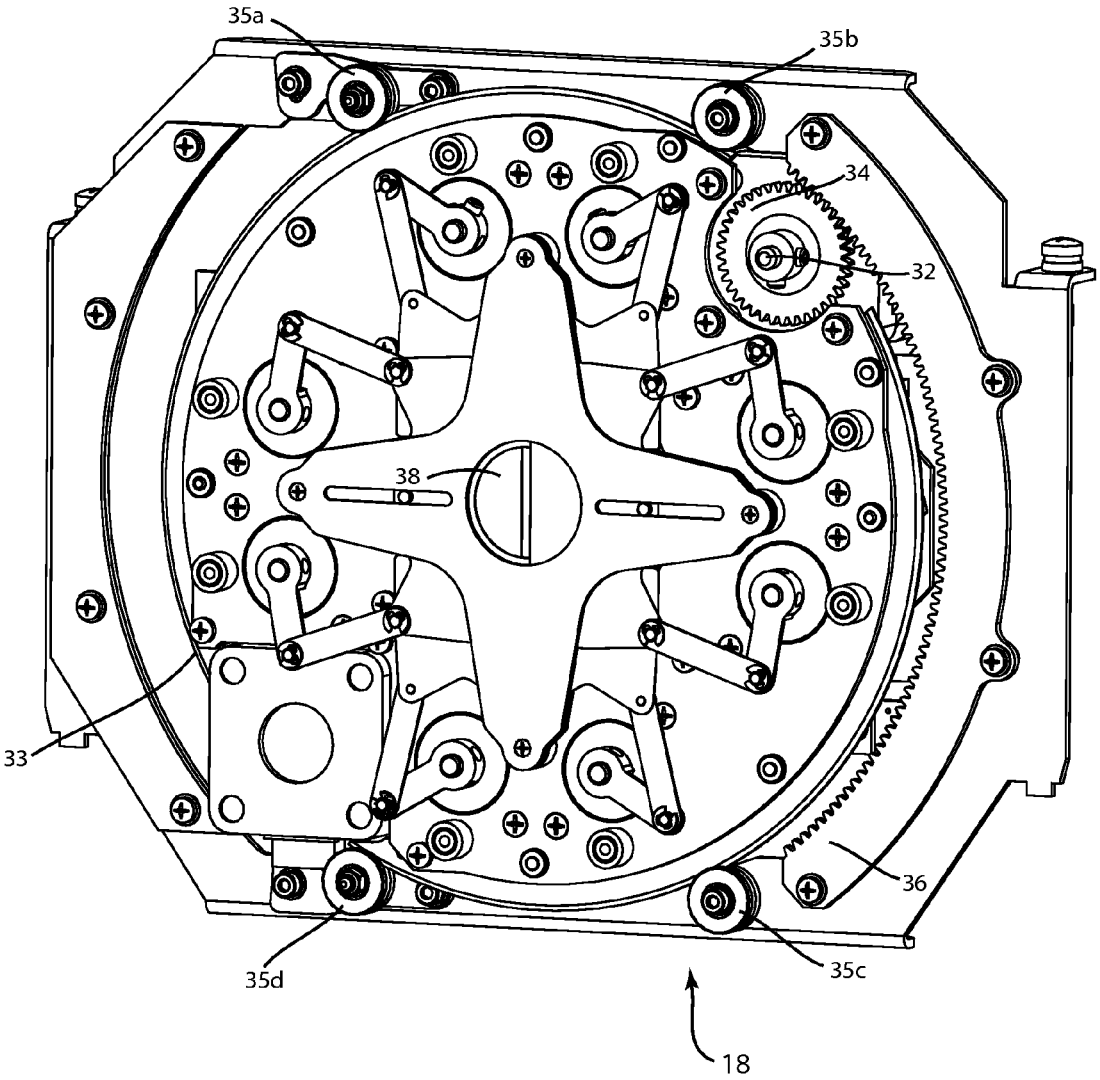
FIG. 17 illustrates an embodiment of the framing shutter system of FIG. 6 with the shutter mechanism further rotated.

FIG. 15 shows an illustration of an embodiment of the invention with all shutter blades and separator plates removed. This reveals the eight motor shafts, two for each shutter blade. In one embodiment, the entire shutter mechanism comprising the four shutter blades, four separator plates and all associated motors and linkages may further be rotated around the optical axis of the luminaire as one piece. FIGS. 16 and 17 may be compared with FIG. 6 to illustrate how this rotation is achieved.

The shutter mechanism comprising the four shutter blades, four separator plates, rotation motor 37 and all associated shutter blade motors and linkages is mounted on plate 33 which is free to rotate around the optical axis of the luminaire within roller bearings 35*a*, 35*b*, 35*c* and 35*d*. System rotation motor output shaft 32 is fitted with gear wheel pinion 34. Gear wheel pinion 34 engages with geared track 36 which is fixed to the static portion of the framing shutter module. As motor 37 and thus motor shaft 32 rotates, gear wheel pinion 34 will move along fixed geared track 36 thus rotating plate 33 and the attached framing shutter mechanism. FIG. 16 shows the system where gear wheel pinion 34 has rotated such that it has moved from the bottom end of track 36 to the center of track 36, and FIG. 17 shows the system where gear wheel pinion 34 has rotated such that it has moved to the top of track 36. Through such a mechanism the framing shutter system may be rotated and positioned at any angle between the extremes of track 36. In one embodiment the total possible angular excursion may be greater than 90°, approximately 120°.

Although a gear system is illustrated for the rotation of plate 33 the invention is not so limited and any system for rotating plate 33 may be utilized. In other embodiments the plate rotation may be effected through direct drive, belt drives, friction drives, or other mechanisms well known in the art. In the illustrated embodiment of the invention all motors are stepper motors. In other embodiments other motor types may be employed.

In the embodiment of the luminaire illustrated in the figures, the operator may adjust the optical systems to provide a hard or soft focus on shutter blade edges and thus produce hard or soft edges to the light beam.

There is no restriction in this description on the type of light source to be utilized with the invention. Any kind of light source as known in the art may be used including, but not limited to, incandescent, high intensity discharge, LED, OLED, and Plasma.

The embodiment described utilizes the same diameter of apertures on the second and third separator plates 52 and 54, such that, when using the horizontal shutter blades 41 and 61, the beam can be focused on the aperture of the second separator plate 52 between those two blades, and when using the vertical shutter blades 51 and 71, the light can be focused on the aperture of the third separator plate 54 between those two blades with no change in aperture size. The apertures in the first and fourth separator plates 42 and 56 may be larger diameter than those in the second and third separator plates 52 and 54.

The design of the described invention using linkage bars and separator plates allows for the mechanism to be very thin. The shutter blades are constrained and guided by the separator plates which prevent any buckling or twisting. A thin framing shutter mechanism has the advantage that all four shutter blades are close to the same optical plane, and thus may be in the focal plane of the projection optics. This allows all four blades to be in sharp focus, or all four blades to be in soft focus, simultaneously.

While the disclosure has been described with respect to a limited number of embodiments, those skilled in the art, having benefit of this disclosure, will appreciate that other embodiments may be devised which do not depart from the scope of the disclosure as disclosed herein. The disclosure has been described in detail, it should be understood that various changes, substitutions and alterations can be made hereto without departing from the spirit and scope of the disclosure.

The invention claimed is:

1. An automated luminaire optical system with a framing shutter system comprising:

a plurality of shutter blades each shutter blade driven by a five-bar linkage driven by two motors and the movement of one of the linkage bars; and where the movement of each such shutter blade is constrained by a spacer plate and where the movement of such shutter blade is further constrained by a slot pin linkage with a slot in the spacer plate where the pin does not share an axis with any of the five-bar linkages.

2. The luminaire of claim 1 where the shutter blade is one of the bar's in the five-bar linkage.

3. The luminaire of claim 2 where the pin whose motion is constrained by the slot in the slot in the spacer plate protrudes from the shutter blade.

4. The luminaire of claim 3 where the pin is equidistant from the linkage connections to the shutter blade.

5. The luminaire of claim 1 where at least one of the shutter blade spacer plates provides a circular aperture for the optical system of the luminaire.

6. The luminaire of claim 1 where a circular aperture in interleaved between at least two shutter blades.

7. The luminaire of claim 1 with two pairs of opposing shutter blades where second pair is configured orthogonally to the first pair.

8. The luminaire of claim 7 where the order of the shutter blades and spacer plates are stacked as follows:

first spacer plate;
first blade of first shutter blade pair;
second spacer plate;
second blade of first shutter blade pair;
first blade of second shutter blade pair;
third spacer plate;
second blade of second shutter blade pair;
fourth spacer plate.

9. The luminaire of claim 8 where the second spacer plate provides the optical system with a circular aperture.

10. The luminaire of claim 8 where the first spacer plate provide the optical system with a circular aperture.

11. The luminaire of claim 9 where the third spacer plate also provides the optical system with a circular aperture.

12. The luminaire of claim 8 where the framing system is mounted to a carrier articulated to rotate the framing system about a cross-section of the optical system.

13. The luminaire of claim 6 where the framing system is mounted to a carrier articulated to rotate the framing system about a cross-section of the optical system.

14. The luminaire of claim 1 where the framing system is mounted to a carrier articulated to rotate the framing system about a cross-section of the optical system.

* * * * *